US006619969B2

(12) United States Patent
Scheider et al.

(10) Patent No.: US 6,619,969 B2
(45) Date of Patent: Sep. 16, 2003

(54) PLUG

(75) Inventors: Josef Scheider, Vienna (AT); Michael Szolga, Vienna (AT)

(73) Assignee: AKG Acoustics GmbH, Vienna (AT)

( * ) Notice: Subject to any disclaimer, the term of this patent is extended or adjusted under 35 U.S.C. 154(b) by 0 days.

(21) Appl. No.: 10/227,592

(22) Filed: Aug. 23, 2002

(65) Prior Publication Data

US 2003/0040205 A1 Feb. 27, 2003

(30) Foreign Application Priority Data

Aug. 24, 2001 (AT) ..... 1351/2001

(51) Int. Cl.[7] ..... H01R 13/44
(52) U.S. Cl. ..... 439/131; 439/31
(58) Field of Search ..... 439/31, 131, 640, 439/668, 669

(56) References Cited

U.S. PATENT DOCUMENTS 4,018,501 A * 4/1977 Maloof ..... 439/669
4,037,319 A * 7/1977 Maloof ..... 29/858
4,964,816 A * 10/1990 Miller ..... 439/669
5,290,179 A * 3/1994 Weingartner ..... 439/669
6,193,559 B1 * 2/2001 Weingartner ..... 439/669
6,439,933 B1 * 8/2002 Moji ..... 439/669
6,461,198 B1 * 10/2002 Chao ..... 439/668
6,461,199 B1 * 10/2002 Koga et al. ..... 439/668

* cited by examiner

*Primary Examiner*—Lynn Feild
*Assistant Examiner*—Thanh-Tam Le
(74) *Attorney, Agent, or Firm*—Friedrich Kueffner

(57) ABSTRACT

A plug, particularly for connecting a musical instrument, a microphone, or the like, to an amplifier, a recording device, or the like, the plug includes a central rod-shaped conductor, a mushroom-shaped part at an end of the rod-shaped conductor, a sleeve of electrically conductive material surrounding the rod-shaped conductor at a radial distance, and an insulating material separating the rod-shaped conductor and the sleeve. A cylindrical bolt is mounted at another end of the rod-shaped conductor and has two bolt portions with different diameters extending transversely of the rod-shaped conductor. The sleeve has electrically conductively connected thereto a surface portion which at least partially surrounds at a radial distance and is electrically insulated from the bolt portion having a smaller diameter.

8 Claims, 2 Drawing Sheets

PLUG

BACKGROUND OF THE INVENTION

1. Field of the Invention

The present invention relates to a plug, particularly for connecting a musical instrument, a microphone, or the like, to an amplifier, a recording device, or the like. The plug includes a central rod-shaped conductor which at one end thereof has a mushroom-shaped portion, a sleeve or electrically conductive material surrounding the rod-shaped conductor at a radial distance, and insulating material which separates the rod-shaped conductor from the sleeve.

2. Description of the Related Art

Plugs of the above-described type have been used successfully for a long period of time in musical instruments, in Hi-Fi units, particularly for connecting the units to headsets, and in many other applications.

Musical instruments, or more precisely the sound-pickups thereof, are usually connected by means of a cable to the respective amplifier, mixer unit, recording unit or sound processing device.

The cables include plugs which are inserted into sockets of the device provided for this purpose. In principle, there are plugs in which the cable extends essentially in the direction of the plug axis away from the device, and plugs in which the cable extends essentially at a right angle to the plug axis. The actual plug itself is of identical construction in each case, so that a cable with one of the two types of plugs is used depending on the specific situation and the desire of the player of the instrument.

For various reasons, the cables have in recent times increasingly been replaced by wireless transmission. This means that a miniaturized transmitter is mounted at the device and that a corresponding receiver is provided at the location of sound processing, amplification, or etc., for each instrument whose signals are transmitted by radio. For simplicity' sake, for connecting the musical instrument to the transmitter, the sockets provided at the musical instrument are used, so that the plugs provided at the transmitters are of the same construction as the plugs previously used at cables.

However, contrary to the transmission of signals by means of cables, in the case of the radio transmitter the orientation of the radio relative to the longitudinal axis of the plug is a critical variable. For example, if in an extremely flat electrical guitar the socket is arranged in such a way that its axis is located in the middle plane of the guitar, the transmitter should also be arranged relative to the plug in such a way that it is located essentially in the continuation of this axis, since otherwise there is the danger that the transmitter will be pulled out of the socket by the use of the instrument.

In contrast, a transmitter which is used on a guitar whose socket is located on the guitar surface and whose axis therefore extends at a right angle relative to the plane of the guitar, should also be arranged so as to extend at a right angle to the plug axis, so that the transmitter does not protrude above the surface of the guitar and impair the playing of the instrument.

Of course, there are a plurality of other applications including those in which signals are once again conducted through a cable; however, the significance of the invention shall be explained with the aid of the examples mentioned above.

In order to meet the above requirement, in the past two types of amplifiers were required to be available. These two types include those which essentially are mounted and arranged in the direction of the plug axis and, in the alternative, those which are mounted essentially in a plane at a right angle to the plug axis which take only little room in the direction of the plug axis.

The plugs themselves are constructed so as to be symmetrical with respect to rotation about the plug axis, which in the inserted state of course coincides with the socket axis, so that the plug is rotatable in the socket. The plug is constructed with a rod-shaped central member which is at one end thereof provided with a mushroom-shaped portion, wherein the rod-shaped member is surrounded over a major portion of its axial length by an electrically conductive cylindrical sleeve which is electrically insulated from the rod-shaped member, wherein the sleeve ends at a distance from the mushroom-shaped portion. This makes a two-pole contact and the mushroom-shaped configuration of one of the contacts ensures that the plug can be secured in the socket in a frictionally engaging manner (resilient tongue, etc.).

Three-pole embodiments are also available, however, these are usually not used for signal transmission from musical instruments, but for example for transmitting stereo signals (headsets, etc.). These plugs are constructed completely analogously to the above-mentioned plugs and, in addition to the rod-shaped member and the cylindrical outer sleeve, these plugs have a tubular central conductor which over only an axial portion between the outer sleeve and the mushroom-shaped portion, has an outwardly exposed surface which can be contacted.

SUMMARY OF THE INVENTION

In view of the prior art discussed above, it is the primary object of the present invention to provide a plug in which different constructions of transmitters, filters or the like are not necessary, or which makes it possible that a cable extending from the plug can always extend at an angle which is optimal for the specific type of application.

In accordance with the present invention, the rod-shaped central member has at its end facing away from the mushroom-shaped end of the plug a cylindrical transverse rod which forms a T-shape relative to the rod-shaped member, wherein the transverse rod has two rod portions having different diameters extending from the center axis of the rod-shaped member, wherein the rod-shaped member and the two rod portions are electrically conductively connected. The outer electrically conductive sleeve is connected in an electrically conductive manner to a surface portion of the sleeve which at least partially surrounds the thinner rod portion at a distance and is electrically insulated therefrom.

As a result of the configuration according to the present invention, it is possible to mount the plug with the T-shaped member rotatably in a bearing, wherein the T-shaped member simultaneously serves as the electrical contact. The bearing can be provided as desired in a transmitting unit, a cable shoe, an electrical filter unit, or any other electronic structural unit. Consequently, the structural component, in which the plug is pivotally mounted, can be arranged at any desired angle when the plug is inserted into the socket, wherein the T-shaped portion serves for the electrical contact of the inner conductor, on the one hand, and the electrical contact of the outer conductor, usually ground, on the other hand.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE INVENTION

Figure 2:
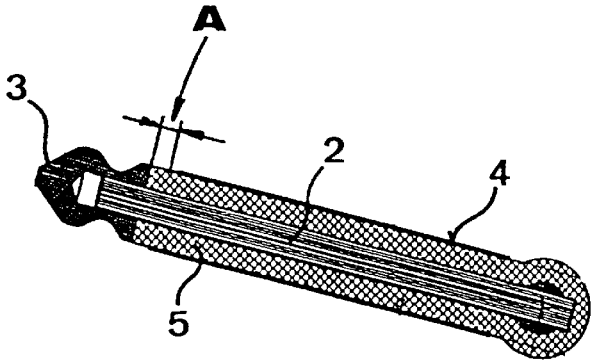
FIG. 2 is a sectional view of the plug of the invention.
Figure 1:
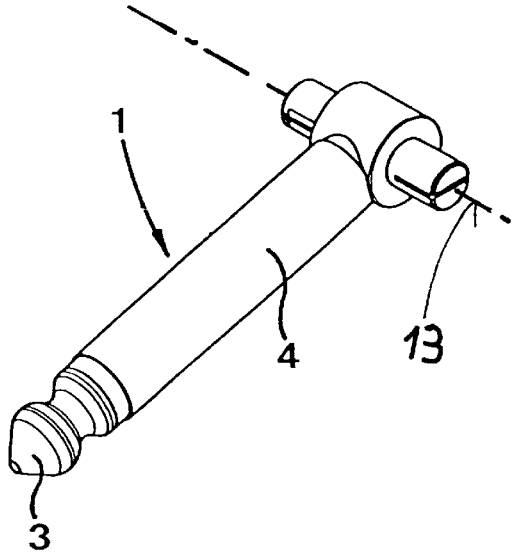
FIG. 1 is a perspective view of the plug according to the present invention without bearing.
Figure 3:
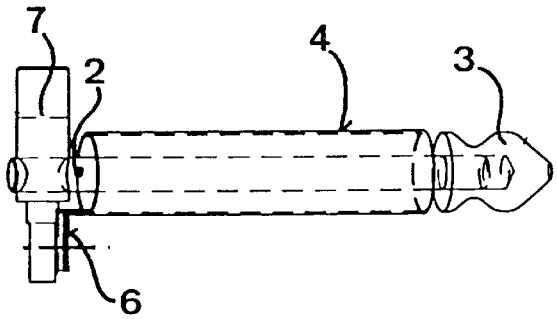
FIG. 3 is a schematic view of the plug of the invention without insulating sleeve.
Figure 5:
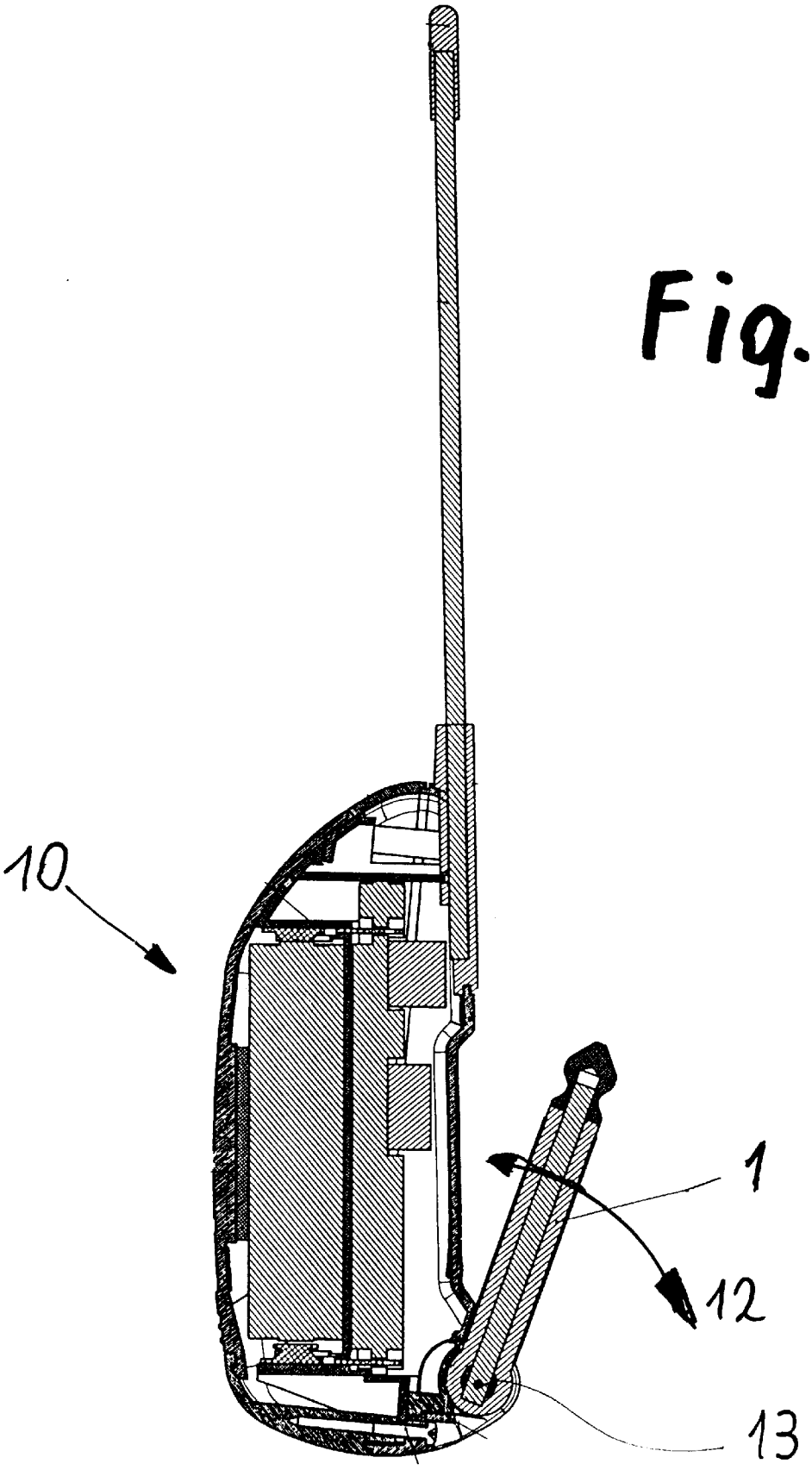
FIG. 5 is an illustration of the plug mounted in a transmitting device.

A plug 1 according to the present invention is shown in FIG. 1. This plug 1 is composed essentially of an electrically conductive rod-shaped member 2 to whose end facing the socket is connected an approximately mushroom-shaped part 3 of an electrically conductive material; the part 3 is connected to the member 2, for example, by hard soldering. The end of the member 2 facing away from the socket is approximately T-shaped and mounted in an electrical device 10 so as to be rotatable about an axis 13, as illustrated in FIG. 5. The plug 1 additionally has a sleeve 4 of an electrically conductive metal which on the side of the socket ends at a distance A from the mushroom-shaped part 3, as shown in FIG. 2. The area between the sleeve 4 and the rod-shaped member 2 or the mushroom-shaped part 3 is electrically insulated by casting or injecting an electrically non-conductive material (insulator) 5, so that these two electrically conductive components are electrically separated from each other.

An essentially L-shaped contact part 6 is mounted on the sleeve 4, wherein the contact part 6 is either integrally formed with the sleeve 4 or is connected by soldering, electrically conductively glued or in another manner. The leg of the L-shaped contact part 6 which protrudes away from the sleeve 4 does not have a flat or planar shape; rather, the leg is shaped in accordance with a circular cylindrical surface whose axis of rotation coincides with the axis 13, seen in FIG. 1, of a bolt 7 having two different diameters. This bolt 7 forms the above-mentioned T-shaped part at the rod-shaped member 2 and the bolt portion having the greater diameter serves for contacting the rod-shaped conductor 2. The outer surface of the L-shaped contact part 6 extends concentrically or in alignment with the outer surface of the rod portion of the bolt 7 having the greater diameter and is mechanically connected to the rod portion having the smaller radius by injecting around the components an electrically nonconductive material, wherein, however, the outer surface of the contact part 6 is exposed, so that a contact with the sleeve 4 can take place.

After injecting the electrically insulating material 5, which is preferably done in the same step with the injection of material around the rod-shaped member 2, the plug 1 has the configuration illustrated in FIG. 1 and can be mounted by means of the two bolt portions of the bolt 7 in a correspondingly shaped bearing in which it is mechanically held so as to be rotatable about its axis 13 and is electrically contacted in all permissible positions.

The type and manner of contacting and the configuration of the T-shaped piece 7 does not have to be carried out in the illustrated way; rather, various modifications are possible: for example, the two bolt portions of the bolt 7 can be provided with different diameters or with different lengths in order to ensure that they are correctly placed in the bearing. The contact leg of the L-shaped contact part 6 may also be constructed as a sleeve, so that it can be electrically contacted over a greater portion of its circumference or over its entire circumference.

Figure 4:
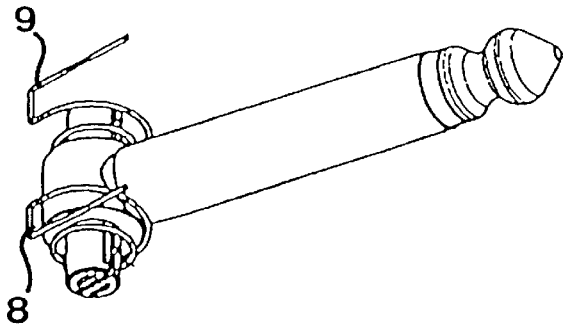
FIG. 4 is a perspective view of another embodiment of the plug according to the invention.

In accordance with an embodiment of the invention, a spring each is arranged at the two bolt portions of the bolt 7, wherein the spring is anchored at least at a slot at the end of one of the bolt portions in order to secure a preferred position of the plug at the device or structural component to which it is rotatably fastened. This embodiment is shown in FIG. 4. Two springs 8, 9 are each mounted on one of the bolt portions and secured and mounted with one end thereof in a radial slot at the end face of the bolt portion. The other end of the spring protrudes essentially tangentially from the cylindrical surface of the bolt portion and can be guided in a corresponding recess in the device in which the plug is rotatably fastened. Between the two ends thereof, the spring is spirally and/or helically guided around the bolt portion and, as a result, is received in each position of the plug in a frictionally engaging manner and with a good contact in the respective receptacles.

FIG. 5 shows, schematically and in section, a plug according to the present invention mounted in a radio transmitter 10; a plug 1 constructed in accordance with the present invention is pivotally supported by means of its bolt portions in a bearing 11, wherein the plug is pressed by means of the springs 8, 9, not visible in FIG. 5, or the resilient elements into the illustrated position. The plug 1 can be pivoted against the force of the spring without exerting a significant force in the direction of arrow 12, so that the position of the radio transmitter 10 relative to the axis of the socket into which the plug 1 is inserted can be adjusted to the specific requirements. The construction of the radio transmitter is not of interest with respect to the invention and, therefore, is not explained herein.

The present invention is not limited to the illustrated embodiments; rather, various modifications are possible. For example, the bolt portions of the bolt 7 may be provided with slots, so that they are radially elastic and rest better against the bearing, which improves the contacting, on the one hand, and serves to secure the plug in its selected position by a frictional engagement. When the plug is pivoted, the contacts are also always cleaned. It is also possible to provide a releasable secured position of the bolt portions in the device in order to maintain an angled position of the plug which is considered favorable at a given time until the device is used with another instrument or the like.

The materials used for the plug are those used for conventional plugs and do not require further explanation. Once familiar with the present invention, those skilled in the art can adapt the invention without problems to three or four poles; therefore, this adaptation is not explained in detail.

The invention is not limited by the embodiments described above which are presented as examples only but can be modified in various ways within the scope of protection defined by the appended patent claims.

What is claimed is:

1. A plug, particularly for connecting a musical instrument, a microphone, or the like, to an amplifier, a recording device, or the like, the plug comprising a central rod-shaped conductor having first and second ends, a mushroom-shaped part at the first end of the rod-shaped conductor, a sleeve of electrically conductive material surrounding the rod-shaped conductor at a radial distance, and an insulating material separating the rod-shaped conductor and the sleeve, further comprising a cylindrical bolt mounted at the second end of the rod-shaped conductor and having two bolt portions with different diameters extending transversely of the rod-shaped conductor, wherein the sleeve has electrically conductively connected thereto a surface portion which at least partially surrounds at a radial distance and is electrically insulated from the bolt portion having a smaller diameter.

2. The plug according to claim 1, comprising an L-shaped conductor forming the surface portion for connecting the sleeve to the surface portion.

3. The plug according to claim 1, wherein at least one of the two bolt portions is provided with a slot.

4. The plug according to claim 1, wherein at least one of the bolt portions has a contact spring.

5. The plug according to claim 4, wherein an end of the contact spring is mounted in a groove in an end face of the bolt portion.

6. The plug according to claim 4, wherein an end of the contact spring is mounted in a radial bore of the bolt portion.

7. The plug according to claim 1, wherein the two bolt portions have equal lengths, and wherein an outer surface of the electrically insulating material and of the conductive surface portion of one of the bolt portions has the same radius as the conductive surface of another of the bolt portions.

8. The plug according to claim 1, wherein the plug is adapted to be mounted in an electronic unit so as to be pivotable about an axis of the bolt and with electrical contact with the bolt portions.

* * * * *